US011825885B2

(12) United States Patent
Dvorak

(10) Patent No.: US 11,825,885 B2
(45) Date of Patent: Nov. 28, 2023

(54) FEMALE UNDERGARMENT

(71) Applicant: Amelia T. Dvorak, Roeland Park, KS (US)

(72) Inventor: Amelia T. Dvorak, Roeland Park, KS (US)

( * ) Notice: Subject to any disclaimer, the term of this patent is extended or adjusted under 35 U.S.C. 154(b) by 0 days.

(21) Appl. No.: 18/133,227

(22) Filed: Apr. 11, 2023

(65) Prior Publication Data

US 2023/0320429 A1 Oct. 12, 2023

Related U.S. Application Data

(60) Provisional application No. 63/330,264, filed on Apr. 12, 2022.

(51) Int. Cl.
*A41B 9/00* (2006.01)

(52) U.S. Cl.
CPC ..... *A41B 9/004* (2013.01); *A41B 2300/35* (2013.01); *A41B 2500/10* (2013.01); *A41B 2500/50* (2013.01)

(58) Field of Classification Search
CPC . A41B 9/004; A41B 2300/35; A41B 2500/50; A41B 2500/10
See application file for complete search history.

(56) References Cited

U.S. PATENT DOCUMENTS 2,355,404 A * 8/1944 Virden ..... A41D 7/005 2/400
2,748,772 A * 6/1956 Titone ..... A61F 13/72 604/397
2,873,738 A * 2/1959 Stark ..... A41D 15/005 450/95
3,237,625 A * 3/1966 Johnson ..... A41B 13/04 604/378
3,939,845 A * 2/1976 Guidoni ..... A41D 7/00 450/86
4,067,068 A * 1/1978 Bregstein ..... A41B 9/004 2/406
4,414,691 A * 11/1983 Estruch ..... A41D 15/005 2/400
D275,524 S * 9/1984 Dost ..... D2/738
2022/0408848 A1 12/2022 Krupa

OTHER PUBLICATIONS

New Fabletics the No Show Brief Size Large Terra Pink, https://poshmark.com/listing/NEW-Fabletics-The-No-Show-Brief-Size-Large-Terra-Pink-MSRP-1195-61ce65d3cb23aac8c9c4b3cy, printed May 11, 2023.

* cited by examiner

*Primary Examiner* — Gloria M Hale
(74) *Attorney, Agent, or Firm* — Akerman LLP; Ryan Harding

(57) ABSTRACT

An undergarment includes a folded fabric attached at lateral edges to form an overlap regions along each side of the undergarment to form a generally triangular configuration complementary to the female anatomy. The overlap region may have a lateral length of about 0.5 inches or more. Some examples may include multiple layers of fabric, natural fiber materials such as jersey knit natural cotton, or both. The undergarment may be assembled using a continuous seam. a fabric wherein the layered assembly comprises jersey knit fabric and the undergarment does not include elastic along body or leg openings, and wherein the layered assembly and the respective first ends and second ends of the upper and lower regions are attached by a continuous seam.

20 Claims, 8 Drawing Sheets

FEMALE UNDERGARMENT

CROSS-REFERENCE TO RELATED APPLICATIONS

The present application claims priority to U.S. Provisional Patent Application No. 63/330,264, filed Apr. 12, 2022, the contents of which are hereby incorporated herein by reference in their entirety.

BACKGROUND

Conventional female underwear is made of a woven or knitted fabric that is cut and sewn together. The common pattern incorporates at least three pieces of single-layer fabric including a front piece, back piece, and gusset that are sewn together in a manner that results in bulk in the seam areas. The fabric is often composed of stretchy synthetic fibers that lacks breathability and traps heat and moisture. Such conventional underwear can interact with the wearer to cause discomfort and may cause negative reactions to the wearer that is some cases may require medical intervention. Conventional underwear often also includes elastic bands or tie strings to keep the underwear in place. However, the elastic bands or tie strings, especially those of the thick variety, are known to interact with the wearer and cause additional discomfort and deflect from providing a smooth appearance under the wearer's clothes.

More recently, underwear that can be knit as a single piece on a circular knitting machine to produce a seamless garment in a variety of sizes and fits have become available. This underwear is made from synthetic fibers, like nylon and elastane, and typically include a 100% cotton gusset. The cotton gusset's effectiveness, however, is reduced due to inherent issues mentioned above with respect to the outer synthetic fiber layer to which it is attached.

The underwear described above is also harmful to the environment due to pollution generated during the manufacturing of the synthetic fibers and thereafter due to the synthetic materials not being degradable and shedding micro plastics when laundered.

SUMMARY

In various aspects, the present disclosure describes improved under garments and methods of making improved undergarments.

In one embodiment, a method of making an undergarment comprises cutting a first layer of fabric into a generally X-shaped configuration having a central region that extends to an upper region having a first area comprising a first end and a second area comprising a second end. The central region also extends to a lower region having a first area comprising a first end and a second area comprising a second end; folding the fabric horizontally across its mid-section to form a generally triangular configuration that has two leg openings and a crotch section between the leg openings and is complemental to the female anatomy; overlapping the first ends and overlapping the second ends; and attaching the first ends to each other and the second ends to each other, and the first layer and the second layer to each other. The overlapping region may comprise at least about 0.5 inches, about 0.75 inches, or more preferably greater than about 1 inch, or between about 1 inch and about 2 inches.

In a preferred embodiment, the method also includes assembling a second layer of fabric corresponding to the first layer of fabric and placing the first layer of a fabric on top of a second layer of fabric to form a layered fabric that may then be folded to form the generally triangular configuration.

In another aspect, an undergarment comprising an overlapping region at lateral sides formed by overlapping first ends of an upper region and lower region (front and rear regions) of fabric and second ends of the upper region and lower region (front and rear regions). The overlapping region may comprise at least about 0.5 inches, about 0.75 inches, or more preferably greater than about 1 inch, or between about 1 inch and about 2 inches.

In a preferred embodiment, the undergarment comprises a layered assembly of fabric.

In preferred embodiments, attachment of the overlapping ends to their respective adjoining ends is a single continuous seam. In layered embodiments, the seam to attach the two layers to each other and to attach the overlapping ends to their adjoining ends is a single continuous seam. Skilled artisans will appreciate that in other embodiments multiple seams may be used to achieve a similar result. In embodiments that have multiple seams, it is preferred that these seams either have a small amount of overlap or are adjacent to each other so that the potential for panty lines is minimized.

In various embodiments, the undergarment may include an interlocking type of stitch to bind the layers along edges that define body openings. Those of skill in the art will appreciate that a variety of suitable interlocking stitches, for example an overcast stitch, whipstitch, zigzag stitch, a serger's interlocking stitch, or a combination thereof may be used in the invention. These types of stitches are preferred so that the seams will stretch with the fabric. Skilled artisans will recognize that other types of stitches that allow for the stitching to stretch with the fabric may also be suitable for use in the invention. Further, skilled artisans will understand that if the thread that is used to sew the layers of fabric together has sufficient stretch, then even a straight or nearly straight stitch may be used effectively in the invention.

While a variety of fabrics may be used, preferred fabrics have a basis weight between 6 and 13 ounces per linear yard, more preferably the fabrics have a basis weight between 9 and 10 ounces per linear yard, and most preferably the fabric has a basis weight of 9.5 ounces per linear yard. Alternatively, each layer of fabric has a weight up to 237 g/m2, more preferably each layer has a weight between 50-200 g/m2.

Preferred fabrics may have a crosswise stretch of up to 50% and a lengthwise stretch of up to 50%. More preferably, each layer of fabric may have a crosswise stretch of up to 25% and a lengthwise stretch of up to 20%. The fabric preferably comprises a natural fiber material. An exemplary natural fiber is cotton, silk, hemp, or wool as to be more hygienic, hypoallergenic, eco-friendly, and provide improved comfort compared to those made from synthetic fibers or blends of natural and synthetic fibers.

In one aspect, an undergarment includes a layered assembly comprising an inner fabric layer and an outer fabric layer. The layered assembly may have an upper region and a lower region, corresponding to rear and front portions of the undergarment. A central region may be positioned between the upper and lower regions and correspond to a crotch portion of the undergarment. The upper region and lower region may each include laterally positioned first and second ends. The undergarment may include a first overlap region along an attachment of the first ends of the upper and lower regions having a lateral length of about 0.75 inches or more and a vertical length of about 0.75 inches or more. The undergarment may include a second overlap region along an attachment of the second ends of the upper and lower regions having a lateral length of about 0.75 inches or more and a vertical length of about 0.75 inches or more. The first and second overlap regions may be diamond shaped. The layered assembly may comprise a jersey knit natural cotton fabric. The undergarment may be configured such that it does not include elastic along body or leg openings. The layered assembly and the respective first ends and second ends of the upper and lower regions may be attached by a continuous seam.

In another aspect, an undergarment includes a fabric having an upper region and a lower region. The upper and lower regions may correspond to a rear and front portions of the undergarment. The fabric may include a central region positioned between the upper and lower regions corresponding to a crotch portion of the undergarment. The upper region and lower region may each include laterally positioned first and second ends. The undergarment may include a first overlap region along an attachment of the first ends of the upper and lower regions having a lateral length of about 0.5 inches or more. The undergarment may include a second overlap region along an attachment of the second ends of the upper and lower regions having a lateral length of about 0.5 inches or more.

In one example, the fabric comprises a first layer and a second layer.

In one example, the upper, lower, and central regions together define leg openings along their lateral sides, and the upper and lower regions together define a body opening. The first and second layers may be seamed along the leg openings, body opening, and attachments of the first ends and second ends with a continuous seam.

In one example, the lateral length of the first and second overlap regions is greater than 0.75 inches.

In one example, the vertical length of the first and second overlap regions is greater than 0.75 inches.

In one example, the lateral length of the first and second overlap regions is greater than 1 inch.

In one example, the vertical length of the first and second overlap regions is greater than 1 inch.

In one example, a lateral length of at least one of the overlap regions increases and decreases along its vertical length.

In one example, a vertical length of at least one of the overlap regions increases and decreases along its lateral length.

In one example, the fabric comprises a first layer and a second layer, and the undergarment does not include elastic.

In one example, the fabric comprises a first layer and a second layer, and the undergarment does not include a draw string.

In one example, the fabric comprises a first layer and a second layer, and the fabric consists of natural fibers.

In one example, the fabric comprises a first layer and a second layer, and the fabric consists of a blend of natural fibers and synthetic fibers.

In one example, the fabric comprises a first layer and a second layer, and each layer of fabric has a basis weight between 6 and 13 ounces per linear yard.

In yet another aspect, a method of making an undergarment may include folding a fabric along a central region positioned between upper and lower regions, wherein the upper and lower regions corresponding to rear and front portions of the undergarment and each including laterally positioned first and second ends. The method may further include overlapping the first ends of the upper and lower regions, overlapping the second ends of the upper and lower regions, and attaching the overlapped first ends and overlapped second ends to form respective first and second overlap regions. The first overlap region may include a lateral length of about 0.5 inches or more, and the second overlap region may include a lateral length of about 0.5 inches or more.

In one example, the lateral length of the first and second overlap regions is greater than 0.75 inches.

In one example, the vertical length of the first and second overlap regions is greater than 0.75 inches.

In one example, the lateral length of the first and second overlap regions is greater than 1 inch.

In one example, the vertical length of the first and second overlap regions is greater than 1 inch.

In one example, a lateral length of at least one of the overlap regions increases and decreases along its vertical length.

In one example, a vertical length of at least one of the overlap regions increases and decreases along its lateral length.

In one example, at least one of the overlap regions is diamond shaped.

In one example, the fabric includes a first layer and a second layer.

In one example, the method further includes attaching the first and second layers and the respective first ends and second ends of the upper and lower regions with a continuous seam.

Other objects, features and advantages of the present will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description. Further, while specific advantages of the invention are detailed herein, various embodiments may include some, none, or all of these enumerated advantages.

BRIEF DESCRIPTION OF THE DRAWINGS

The invention may be better understood by reference to the drawings together with the description presented herein.

DESCRIPTION

A continuing need exists for improved undergarments that can provide a smooth appearance and that are also hygienic and comfortable to wear. In various embodiments, the present disclosure describes undergarments and methods of making such undergarments that are hygienic and provide a smooth appearance. The undergarments may be assembled from natural materials to provide an 100% natural fiber underwear that is the healthiest for the body (skin and vaginal area) and environmentally friendly. Unlike conventional underwear that have seams attaching elastic around the body openings, a small central gusset, gusset seams, or alternatively, tie strings, undergarments described herein may beneficially exclude elastic, synthetic fibers, or strings. By eliminating the elastic or tie strings, bulk is removed from the undergarment, panty lines are reduced or eliminated, and a smoother appearance is achieved. Bulk is also minimized by reducing the assembly points from three to two. Additionally, eliminating synthetic fibers results in an environmentally friendly garment that is biodegradable.

The present description described various configurations of an improved undergarment of the type typically referred to as panties. The undergarment may be configured to provide improved comfort while also reducing or eliminating panty lines for a smooth appearance. In some configurations, the undergarment may be assembled from hypoallergenic materials.

In one aspect, an undergarment may comprise a layered assembly. For example, the undergarment may comprise a first layer and a second layer wherein the first layer underlays the second layer. Each layer may comprise a knit fabric. In various embodiments, the layers may be assembled in the manner described herein wherein neither elastic nor synthetic fibers are needed to achieve an undergarment that does not ride up or fall down. Preferred knit fabrics include jersey knit fabrics.

In some embodiments, the layers may comprise the same material, for example a same jersey fabric. In some embodiments, the layers comprise a same natural fiber material. An exemplary natural fiber is cotton, silk, hemp, or wool. Skilled artisans will recognize that fabrics that are cotton blends, or blends of natural fibers with synthetic fibers may be used in the invention, as long as such fabrics function as intended in undergarments of the invention. Advantageously, by using natural fibers, undergarments described herein may be more hygienic, hypoallergenic, eco-friendly, and provide improved comfort compared to those made from synthetic fibers or blends of natural and synthetic fibers.

In another aspect, an undergarment comprises single base layer of fabric. The fabric may be as described herein with respect to layered fabric embodiments.

FIGS. 1-11 illustrate various embodiments and views of undergarments 1 and features thereof according to various embodiments described herein, wherein like numbers identify like features.

Figure 1:
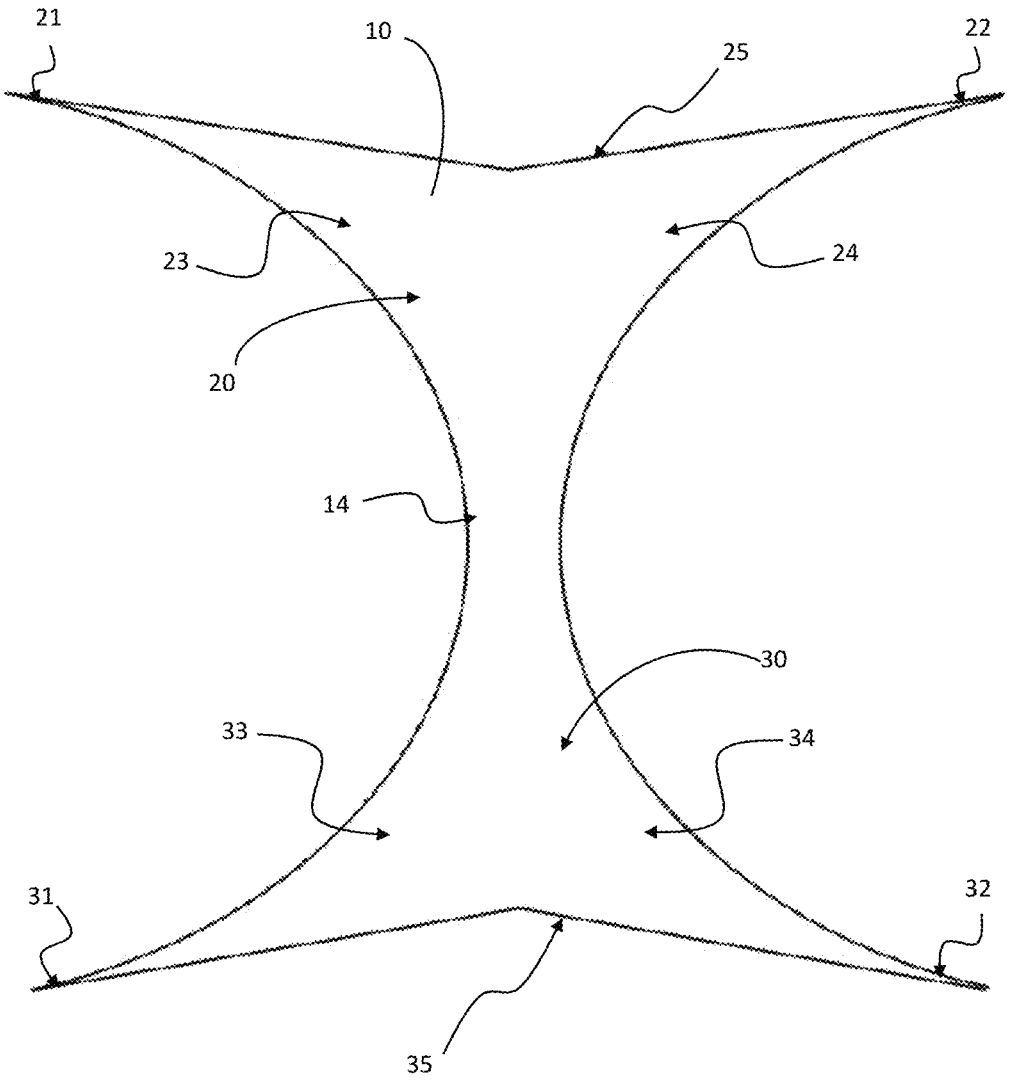
FIG. 1 illustrates a piece of unfolded fabric that has been cut for assembly of an undergarment according to various embodiments described herein.
Figure 2:
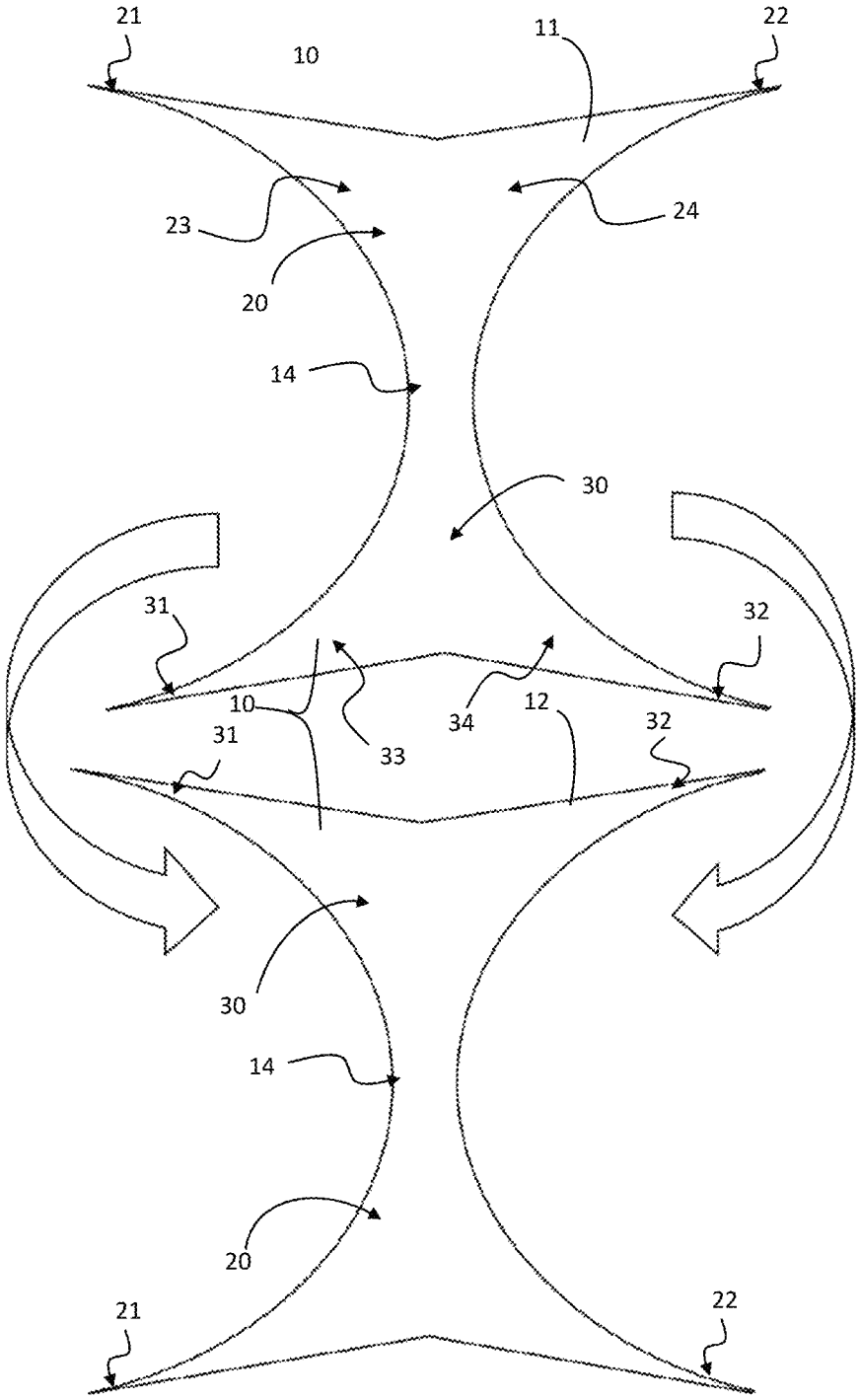
FIG. 2 depicts an assembly step of two pieces of unfolded fabric cut as illustrated in FIG. 1 for assembly of an undergarment according to various embodiments described herein.
Figure 4:
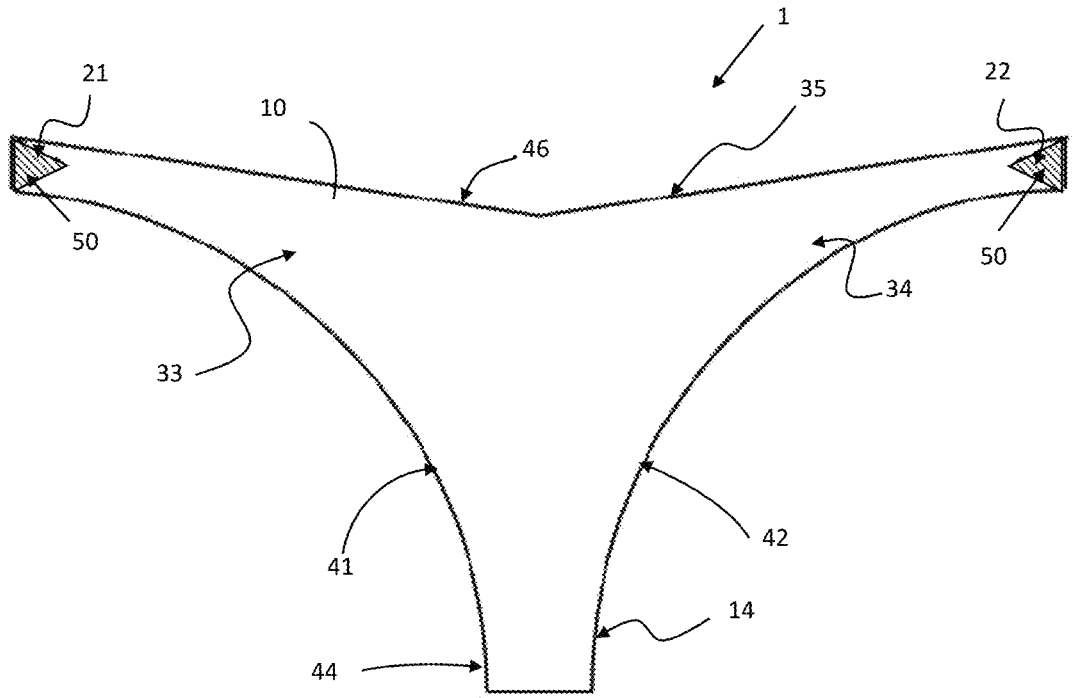
FIG. 4 illustrates perspective view of an assembled undergarment according to various embodiments described herein.

With reference to FIG. 1, the undergarment 1 may comprise at least a first layer of fabric 10. If laid out, as depicted in FIG. 1, the fabric 10 may have a general X-shape that comprising a narrow central region 14 from which extend and upper region 20 and a lower region 30. The upper region 20 includes first and second upper areas 23, 24 and the lower region 30 includes first and second lower areas 33, 34. The first and second areas 23, 24, 33, 34 of the upper and lower regions 20, 30 each decrease in vertical length, e.g., taper, laterally toward an end 21, 22, 31, 32. While the first and second areas 23, 24, 33, 34 of the upper and lower regions 20, 30 each extends to an end 21, 22, 31, 32, which are illustrated as being relatively pointed in this embodiment; however, those of skill in the art will appreciate that an end 21, 22, 31, 32 does not need to terminate in a point. For example, one or more ends 21, 22, 31, 32 may be rounded, blunt, or otherwise shaped as desired, e.g., as depicted and described in more detail below with respect to FIGS. 5-8 and the accompanying text. The upper and lower regions 20, 30 also include a base end 25, 35 positioned between laterally positioned ends 21, 22, 31, 32. The base ends 25, 35 may correspond to a waste portion when assembled providing a body opening 46 (FIG. 4). The base ends 25, 35 are illustrated as defining a convex edge between the laterally positioned ends 21, 22, 31, 32. In some embodiments, one or both of the base 25, 35 define a level edge.

As described in more detail herein, the undergarment 1 may comprise a layered assembly of fabric 10. For example, with reference to FIG. 2, in some embodiments, the undergarment 1 may include a first layer fabric 11 and a second layer fabric 12. The second layer fabric 12 may be positioned over the first layer fabric 11 for assembly. However, in other embodiments, the undergarment 1 comprises a single layered assembly or a multilayered assembly configured in a manner different than depicted in FIG. 2.

Figure 3:
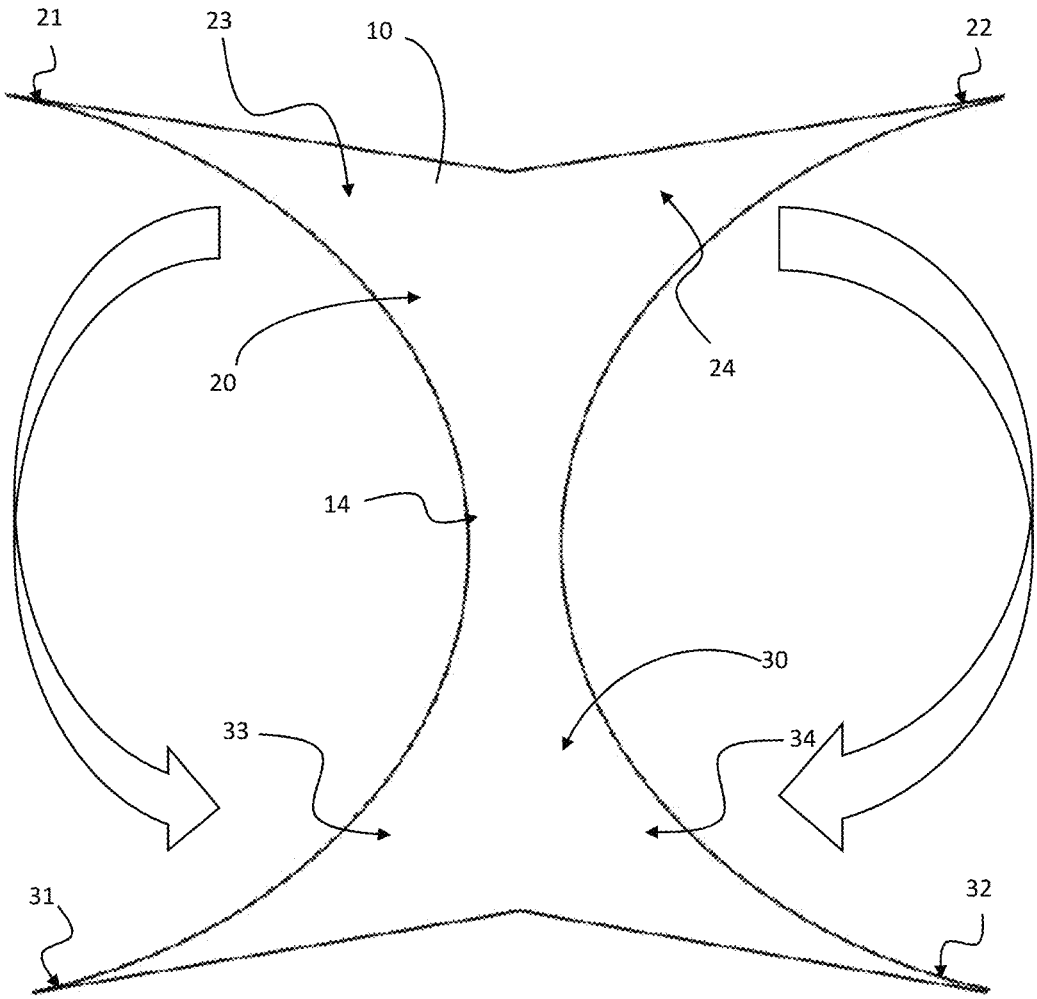
FIG. 3 depicts a further assembly step of folding the two pieces of unfolded fabric layer on top of each other according to the assembly of FIG. 2 for assembly of an undergarment according to various embodiments described herein.

With particular reference to FIG. 3, the upper region 20 (upper half) of the fabric 10, which may include a first layer fabric 11, a first layer fabric and one or more second layer fabric 12, may be folded along the width of the central region 14 to meet the lower region 30 (lower half) to form a generally triangular configuration, see FIG. 4, that has two leg openings 41, 42, a crotch section 44 between the leg openings 41, 42, and an upper body opening 46. For example, the undergarment 1 may define a plurality of body openings formed by the assembled fabric 10. The fabric 10 may include first ends 21, 31 and second ends 22, 32 corresponding to the first and second areas 23, 24, 33, 34 of the upper and lower regions 20, 30, that extend away from the crotch section 44, and wherein, when folded together horizontally along the crotch section 44, a generally triangular configuration complementary to the female anatomy is formed. Similarly, in certain configurations including an inner layer fabric, e.g., a first layer fabric 11, and an outer layer of fabric, e.g., a second layer fabric 12, the inner layer and the outer layer may each include a first end 21, 31 and a second end 22, 32 corresponding to first and second areas 23, 24, 33, 34 of the upper and lower regions 20, 30, that extend away from the crotch section 44, and wherein, when folded together horizontally along the crotch section 44, a generally triangular configuration complementary to the female anatomy is formed.

With reference to FIGS. 5-8, when assembled, the four ends 21, 22, 31, 32 of the fabric 10 may overlap to form an overlap region 50. Specifically, the first ends 21, 31 of the upper and lower regions 20, 30 and the second ends 22, 32 of the upper and lower regions 20, 30 may overlap, typically forming a side portion of the undergarment 1. For example, the first and second ends 31, 32 of the lower region 30 may fold over or under the first and second ends 21, 22 of the upper region 20 as to overlap with the same. In some embodiments, the first end 31 of the lower region 30 may fold over the first end 21 of the upper region 20 and the second end 32 of the lower region 30 may fold under the second end 22 of the upper region 20. The illustrated embodiments depict the overlap region 50, however, one end is typically positioned over the other, obscuring it from view from one side of the undergarment 1, though threads may be visible. As described in more detail below, seams may be provided along a perimeter of the overlap region 50 to attach the respective ends 21, 31, 22, 32 and provide ample reinforced support.

Figure 5:
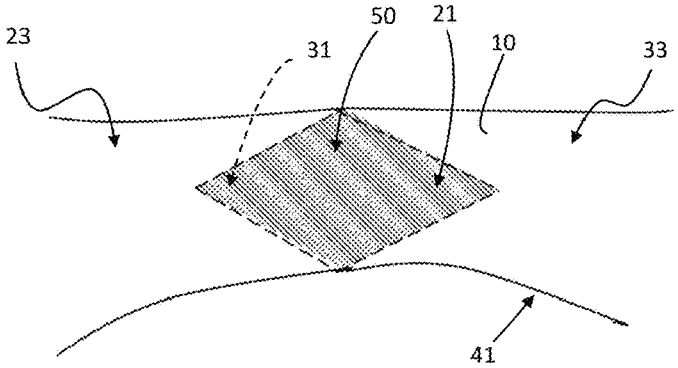
FIGS. 5-8 illustrate various isolated side views of overlapped attachment configurations of an undergarment according to various embodiments described herein.
Figure 6:
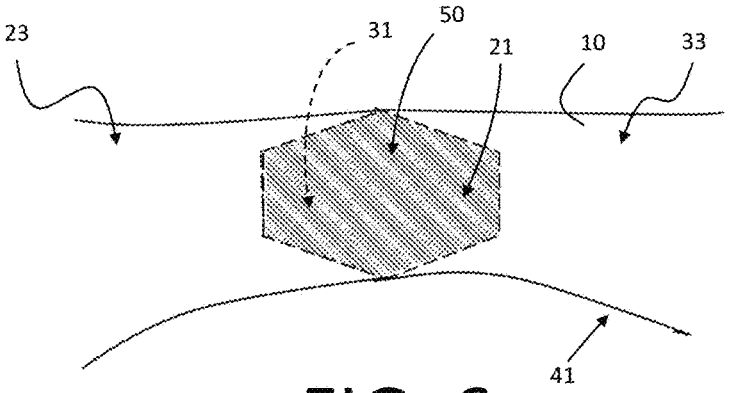
Figure 7:
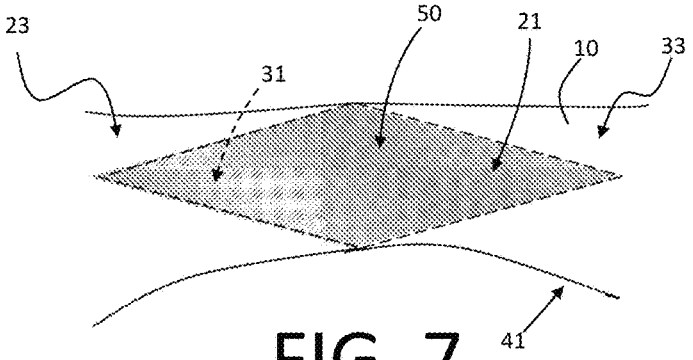
Figure 8:
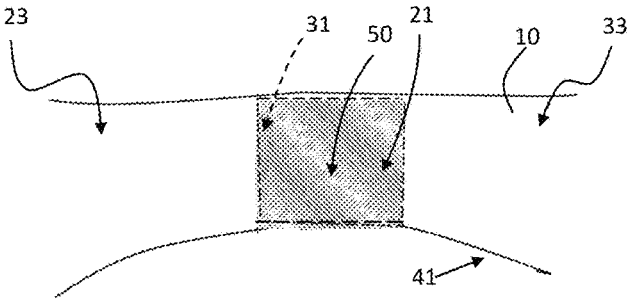

FIG. 5 illustrates an embodiment, wherein the first and second ends 21, 31 of the lower and upper regions 20, 30 overlap to form an overlap region 50. The ends 21, 31 are pointed and when overlapped form a generally diamond shape overlap region 50 when sewn together. FIG. 6 illustrates another embodiment where the overlapping ends 21, 31 are truncated providing a hexagon shape overlap region 50. FIG. 7 illustrates overlapping ends 21, 31 of the undergarment 1 overlapping to form an overlap region 50 having an elongated diamond shape. In some embodiments, the elongated ends 21, 31 of the diamond may provide an overlap region 50 greater than 2 inches of overlap, although less overlap may be used, as described above. FIG. 8 illustrates overlapping ends 21, 31 that are truncated such that when they overlap they form an overlap region 50 that has a generally square or rectangular shape. In other embodiments, the ends 21, 31 may overlap to define rounded edges, e.g., forming circular, oval, or oblong overlap regions 50. In some embodiments, the ends may overlap to define other geometric or non-geometric, e.g., free-form, shapes.

A lateral length of the overlap region 50 may be greater than about 0.25 inches, about 0.5 inches or greater, preferably about 0.75 inches or greater, or more preferably about 1 inch or greater, such as between about 0.5 inches and about 3 inches, between about 0.75 inches and about 3 inches, between about 0.75 inches and about 2.5 inches, between about 0.75 inches and about 2 inches, between about 0.75 inches about 1.5 inches, between about 0.75 inches and about 1.25 inches, or between about 1 inch and about 2 inches. In various embodiments, the overlap region 50 may have vertical length dimension in combination with any of the above lateral lengths greater than about 0.25 inches, about 0.5 inches or greater, preferably about 0.75 inches or greater, or more preferably about 1 inch or greater, such as between about 0.5 inches and about 3 inches, between about 0.75 inches and about 3 inches, between about 0.75 inches and about 2.5 inches, between about 0.75 inches and about 2 inches, between about 0.75 inches about 1.5 inches, between about 0.75 inches and about 1.25 inches, or between about 1 inch and about 2 inches. The lateral and vertical lengths may be a largest dimension. In one example, the overlap region 50 has a lateral length dimension between about 0.75 inches and about 1.5 inches and a vertical length dimension between about 0.75 inches and about 1.5 inches. In some embodiments, the lateral length dimension increases and then decreases, moving vertically. In these or other embodiments, the vertical length dimension increases and then decreases, moving laterally. In one embodiment, the lateral length of the overlap region increases vertically to a length dimension between about 0.75 inches and about 1.5 inches and the vertical length increases laterally to a vertical length between about 0.75 inches and about 1.5 inches. In a further example, the lateral or vertical length may decrease vertically or laterally. In another embodiment, one or both of the lateral length dimension or vertical length dimension of the overlap region decrease when taken vertically or laterally, respectively.

As introduced above, the fabric 10 may comprise first and second fabric layers 11, 12. As such, the ends 21, 22, 31, 32 may comprise layered ends wherein their overlap may provide an overlap region 50 of four layers along the overlap along the lateral sides of the undergarment 1 while in single layer embodiments the overlap region 50 comprises two layers. In some embodiments, the ends 21, 22, 31, 32 do not significantly overlap and may be joined by a typical vertical seam or glued.

Preferably, a single continuous seam attaches the raw edges (edges) of the first fabric layer 11 and second fabric layer 12 to each other (in layered embodiments), the first ends 21, 31 of the upper and lower regions 20, 30 to each other, and the second ends 22, 32 of the upper and lower regions 20, 30 to each other. Alternatively, the edges of the first fabric layer 11 and second fabric layer 12 (in layered embodiments), first ends 21, 31 of the upper and lower regions 20, 30, and second ends 22, 32 of the upper and lower regions 20, 30 can be attached to each other by using multiple seams. In embodiments that include multiple seams, it is preferred that the seams have little or no overlap so that potential for panty lines is reduced such that a smooth appearance is presented over the line of stitching. In some embodiments, the first ends 21, 31 of the upper and lower regions 20, 30 and the second ends 22, 32 of upper and lower regions 20, 30 may be glued rather than sewn.

According to various embodiments, panty lines associated with side and top seams that have elastic are eliminated both by not having elastic in the seams or around the upper body opening 46, leg openings 41, 42, or both, and by moving the areas of stitching to different areas of the undergarment that are less likely to cause visible panty lines. See, e.g., FIG. 11.

Skilled artisans will appreciate that a variety of stitch types are suitable for use in the assembling of an undergarment 1 described herein. For example, an overcast stitch, whipstitch, zigzag stitch, a serger's interlocking stitch, or a combination thereof may be used to assemble an undergarment of the invention. Preferred stitches are about 3.5 mm in width and about 1.5 mm in length.

It is preferred that in layered embodiments, the first fabric layer 11 and second fabric layer 12 may be attached to each other around the leg openings 41, 42 and a body opening 46 along their adjoining edges. Preferably, these seams can extend from the outer edges of the layered fabric to about ¼ inch inward from the outer edges. The skilled artisan will understand that if a wider stitch is used to attach the two layers to each other, then the resulting seams may extend further inward from the edges.

Figure 9:
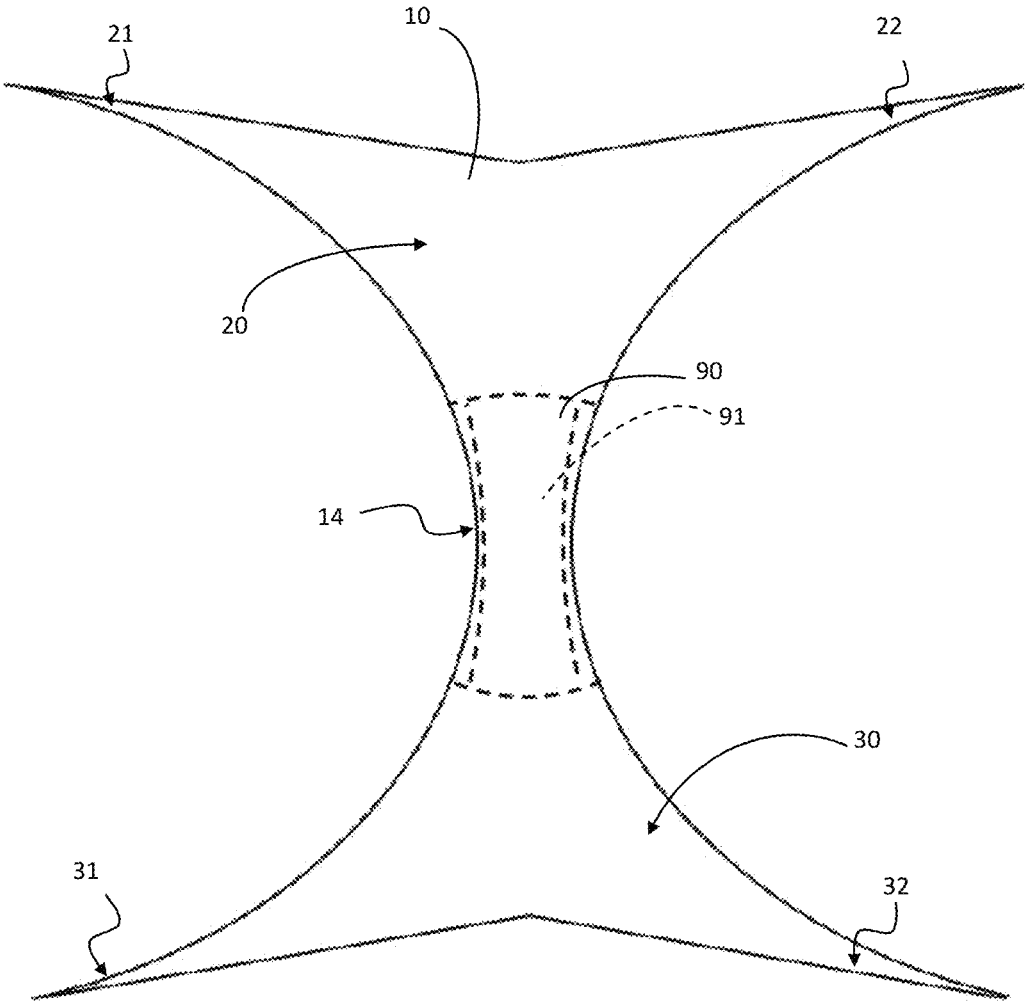
FIG. 9 illustrates an unfolded view of an absorbent undergarment according to various embodiments described herein.
Figure 10:
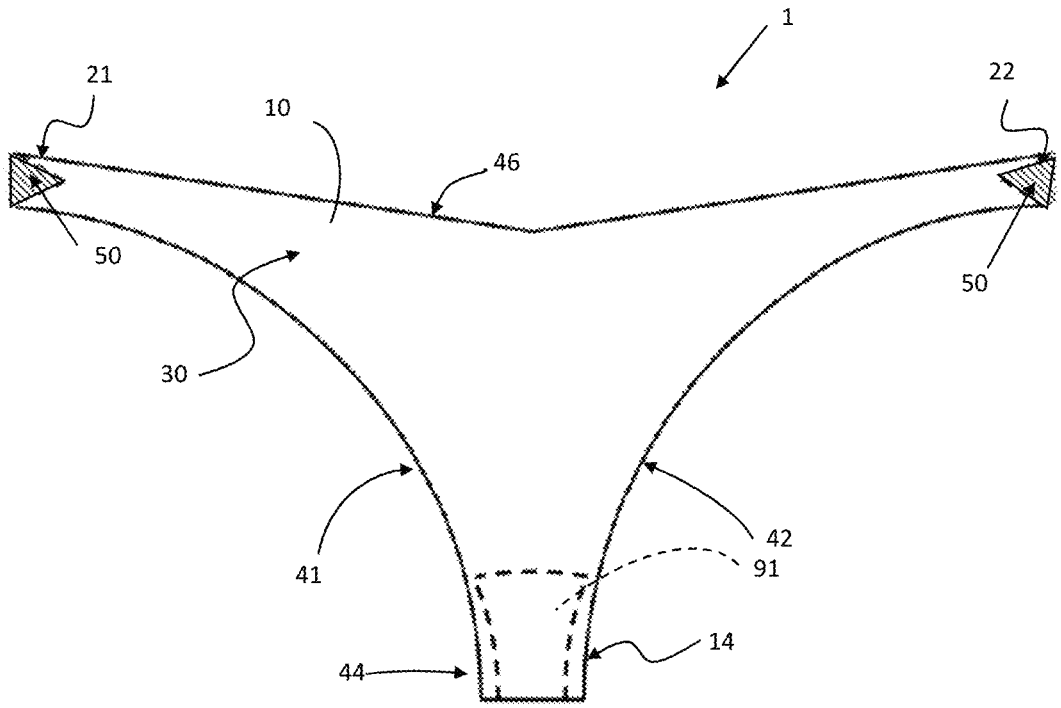
FIG. 10 illustrates a perspective view of an assembled absorbent undergarment according to various embodiments described herein.

With reference to FIGS. 9 & 10, in various embodiments, the undergarment 1 may comprise an absorbent undergarment 1' including a pocket 90 along the crotch region 44 for retaining an absorbent or otherwise pad 91. The absorbent undergarment 1' may find use as period underwear or for other applications when a more absorbent undergarment is desired. For example, the absorbent undergarment 1' may be used in conjunction with urinary incontinence, such as incontinence during pregnancy, postpartum incontinence, urinary stress incontinence, bladder weakness, functional incontinence, or incontinence related to a medical condition, such as diabetes, infects, or disorders. In the illustrated embodiment, the pocket 90 is sewn into the crotch region 44 between the first fabric layer 11 and second fabric layer 12 of body of the undergarment 1'. FIG. 9 depicts the two layer assembly before attachment of the respective ends 21, 31, 22, 32. FIG. 10 depicts the undergarment 1' with the layered ends 21, 31, 22, 32 overlapped and attached in a diamond overlap region 50 configuration. As noted above, is some embodiments, other overlap region 50 configurations may be used, such as those described elsewhere here. In other embodiments, embodiments seamed configurations may be used along perimeters of the attached ends 21, 31, 22, 32 as also described elsewhere herein.

The pocket 90 comprises a sewn compartment having sides formed by sewn portions of the first fabric layer 11 and second fabric layer 12. In another configuration, the pocket 90 includes additional material or an additional layer of material sewn between or on top of one of the first fabric layer 11 or second fabric layer 12. In one example, the pocket 90 may be sewn into the crotch region 44 of one of the two layers of the body, e.g., along an inwardly facing side with respect to the wearer of the first fabric layer 11 or second fabric layer 12, as the case may be, or along an outwardly facing side with respect to the wearer of the first fabric layer 11 or second fabric layer 12, as the case may be. Similar pockets 90 may be included in single layer embodiments.

In the illustrated embodiment, a pad 91 may be sewn within the pocket 90 to be retained therein. In other embodiments, the undergarment 1' comprises a pocket 90 having an accessible opening for insertion and removal of a pad 91. In one configuration, the opening is provided along one of the first fabric layer 11 or second fabric layer 12 of the undergarment body as to be continuous with the respective layer. In another embodiment, the opening may be provided between the first fabric layer 11 or second fabric layer 12 of the undergarment body, e.g., along a lateral side of the crotch region 44. In any of the above or another example, the opening may include attachment structures configured to be selectively attached and detached to open and close the opening. The attachment structures may include any suitable attachment structures such as mateable attachment structures. Example attachment structures may include a hook and loop, snaps, rail and groove, buttons, press or interference fit, magnets, or the like. In some embodiments, the undergarment 1' may be configured to selectively attach with a pad or selectively removable pad pocket 90. For example, the crotch may include attachment structures, such as those described above, for selectively attaching to a selectively removable pad 91 or pad pocket 90. In one example, attachment structures are positioned along the side of the crotch region 44 configured to face the wearer in use. In another example, attachment structures are positioned along the side of the crotch region 44 configured to face away of the wearer in use such that lateral flaps positioned on a selectively removable pad 91 or pad pocket 90 may wrap around the lateral sides of the crotch region 44 to selectively attach to the underside thereof.

The absorbent undergarment 1' may comprise and/or be constructed as otherwise described herein. The pad 91 may comprise various materials. In one embodiment, the pad 91 comprises a felted wool. In another or a further embodiment, the pad 91 comprises one or more layers of natural fiber fabric. In one example, the natural fiber fabric comprises the same fabric as is utilized in the body of undergarment 1'.

As introduced above, one or more of the second ends 22, 32 or the first ends 21, 31 are preferably attached to each other with a single continuous seam. It is also preferred that the edges of the first fabric layer 11 and second fabric layer 12 are attached to each other along their edges such that no seam allowance is present between the stitching and the edges of the undergarment 1.

Figure 11:
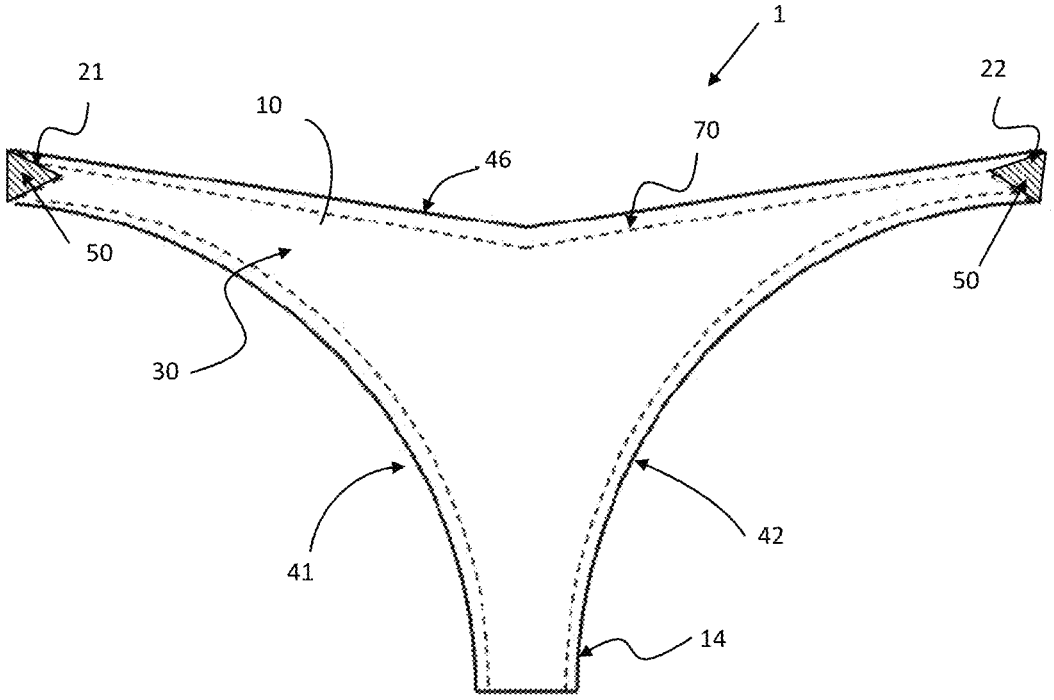
FIG. 11 illustrates a perspective view of an assembled undergarment as described herein sewn with a continuous seam according to various embodiments described herein.

With reference to FIG. 11, in some embodiments, a continuous seam 70 may be used to attach the edges, e.g., raw edges, of the first layer fabric 11 and second layer fabric 12 each other, with a small unsewn area left at one of the corners, then turned inside out, and sewn again at the outer edges with the first ends 21, 31 to each other, and the second ends 22, 32 to each other. The continuous seam 70 may extend around the perimeter of the undergarment 1, along leg openings 41, 42 and upper body openings 46. The continuous seam 70 may further include attaching ends 21, 31, 22, 32, which may further include an overlap region 50 as described herein. In some embodiments, the continuous seam 70 is a single continuous seam. In some embodiments one or more additional seams may be included. However, in one embodiment, only a continuous seam 70, which may be a single continuous seam.

With reference again to FIG. 10, in some embodiments, an additional layer, like a pad 91, may be positioned in the crotch region 44 and between the first fabric layer 11 and second fabric layer 12 and sewn in that area in the same manner to how the first fabric layer 11 and second fabric layer 12 are sewn together in one continuous seam as previously described.

In one aspect, the undergarment comprises two layers of fabric, e.g., a first fabric layer 11 and second fabric layer 12. The layers may be stitched together in the manner described herein that neither elastic nor stretchy synthetic fibers or fabric are needed to achieve an undergarment that does not ride up or fall down. Rather the undergarment is configured to stay comfortably in place on the wearer. Further, by assembling the layers as described herein, seams may be minimized and panty lines associated with elastic bands may also be eliminated.

In some embodiments, the two layers of fabric from which the undergarment 1 may be assembled comprise jersey knit fabric. In one such example, an exemplary undergarment includes two layers of jersey fabric that have the wrong sides of the fabric facing each other. A single layer of jersey material (also known as single knit, plain knit, or tricot) has a right side and a wrong side. The right side of the material is marked by a series of very small vertically running lines, and the wrong side has a horizontal grain. A preferred jersey fabric is a 100% organic cotton. However, other natural fibers, e.g. hemp, silk, or wool, may also be used additionally or alternatively. Further, some embodiments may comprise a blend of natural and synthetic fibers. It is preferred that both layers of fabric comprise the same type of fabric, but the skilled artisan will appreciate that the two layers can comprise two different types of fabric, as long as, the two layers of different fabrics allow the undergarment to stay comfortably in place on the wearer and have reduced or eliminated panty lines so that a smoother appearance is achieved. While full synthetic fabrics are not preferred as such fabrics do not result in an undergarment composed of natural materials that provide a more hygienic, hypoallergenic, eco-friendly undergarment, various embodiments may utilize such synthetic fabrics to take advantage of the improved comfort, support, construction, and aesthetics, such as reduced panty lines, described herein.

Preferred fabrics include those fabrics having a weight up to 7 oz./yd$^2$ (or up to 237 g/m2), more preferably between 0.9-6.5 oz./yd$^2$ (or 30-220 g/m2), even more preferably between 1.5-5.9 oz./yd$^2$ (or 50-200 g/m2), and most preferably a weight of 5.6 oz./yd$^2$ (or 190 g/m2). Preferred fabrics also have a crosswise (weft) stretch of up to 50% and a lengthwise (warp) stretch of up to 50%, more preferably they have a crosswise (weft) stretch of up to 35% and a lengthwise (warp) stretch of up to 30%, and most preferably a crosswise (weft) stretch of up to 25% and a lengthwise (warp) stretch of up to 20%.

Preferably, when viewing the undergarment from the front, the fabric is on grain rather than a bias. Nevertheless, the skilled artisan will appreciate that the fabric may be cut on grain or a bias, as long as the undergarment is capable of staying comfortably in place on the user.

It is preferred that each layer is a single piece of fabric so that additional seams are not introduced into the undergarment. The layered fabric has been cut into a generally X-shape that has a narrow central region from which extend four areas, and each area includes an end. Two of the areas form an upper region, and the other two areas form a lower region. For an exemplary women's size small or medium, the layered fabric is about 18 inches from the ends of the lower region to the ends of the upper ends; about 14.5 inches from one upper end to the other upper end; about 14.5 inches from one lower end to the other lower end; and about 2 inches across the narrowest width of the central region. Those of skill in the art will appreciate that these widths and lengths may be greater or smaller for different sizes.

Those of skill in the art will appreciate that different sizes of undergarments will require different fabric dimensions. Thus, it will be understood that the fabric dimensions that are used herein to describe the making of an exemplary undergarment will vary with the sizes of the undergarment that are being made. For example, in the United States the difference between two sizes (e.g. 10, 12, 14, etc.) is commonly plus or minus about one inch. When the sizes are identified as small, medium, large, etc., there can be a difference of more than one inch between sizes, and a single size may have greater variation as compared to numbered sizes. As described above, various embodiments of the undergarment described herein may be configured without one or more of seams attaching elastic around the body openings, a central gusset, gusset seams, or tie strings. Additionally or alternative, such undergarments may be assembled from natural fiber fabric essentially free of synthetic fibers.

Unless defined otherwise, all technical and scientific terms used herein have the same meaning as is commonly understood by one of skill in the art to which this invention belongs at the time of filing. Terminology used herein is for the purpose of describing exemplary embodiments of the invention and is not intended to be limiting. The meaning and scope of terms should be clear; however, in the event of any latent ambiguity, definitions provided herein take precedent over any dictionary or extrinsic definition. Further, unless otherwise required by context, singular terms shall include pluralities and plural terms shall include the singular unless the content clearly dictates otherwise. Herein, the use of "or" means "and/or" unless stated otherwise. Furthermore, the use of the terms "including", "comprising", as well as other forms such as "includes", "included", "comprises", "comprised", or similar terminology is not limiting. As used herein, "each" refers to each member of a set or each member of a subset of a set.

Any numerical range recited herein includes all values and ranges from the lower value to the upper value. For example, if a range is stated as 1% to 50%, it is intended that values such as 2% to 40%, 10% to 30%, 1% to 3%, or 2%, 25%, 39% and the like, are expressly enumerated in this specification. These are only examples of what is specifically intended, and all possible combinations of numerical values and ranges between and including the lowest value and the highest value enumerated are to be considered to be expressly stated in this application. Numbers modified by the term "about" are intended to include +/−10% of the number modified.

It should be appreciated by those of skill in the art that the techniques disclosed herein represent techniques discovered to function well in the practice of the invention, and thus can be considered to constitute preferred modes of practice. However, those of skill in the art should appreciate that many changes can be made to the specific embodiments which are disclosed and still obtain a like or similar result without departing from the spirit or scope of the invention.

What is claimed is:

1. An undergarment comprising:

a layered assembly comprising an inner fabric layer and an outer fabric layer;

the layered assembly having an upper region and a lower region corresponding to rear and front portions of the undergarment and a central region positioned between the upper and lower regions corresponding to a crotch portion of the undergarment, wherein the upper region and lower region each include laterally positioned first and second ends;

a first overlap region along an attachment of the first ends of the upper and lower regions having a lateral length of about 0.75 inches or more and a vertical length of about 0.75 inches or more; and a second overlap region along an attachment of the second ends of the upper and lower regions having a lateral length of about 0.75 inches or more and a vertical length of about 0.75 inches or more, wherein the first and second overlap regions are diamond shaped, wherein the layered assembly comprises jersey knit natural cotton fabric and the undergarment does not include elastic along body or leg openings, and wherein the layered assembly and the respective first ends and second ends of the upper and lower regions are attached by a continuous seam.

2. An undergarment comprising:

a fabric having an upper region and a lower region corresponding to a rear portion and a front portion of the undergarment and a central region positioned between the upper and lower regions corresponding to a crotch portion of the undergarment, wherein the upper region and lower region each include laterally positioned first and second ends;

a first overlap region along an attachment of the first ends of the upper and lower regions having a lateral length of about 0.5 inches or more; and a second overlap region along an attachment of the second ends of the upper and lower regions having a lateral length of about 0.5 inches or more.

3. The undergarment of claim 2, wherein the fabric comprises a first layer and a second layer.

4. The undergarment of claim 2, wherein the upper, lower, and central regions together define leg openings along their lateral sides and the upper and lower regions together define a body opening, and wherein the first and second layers are seamed along the leg openings, body opening, and attachments of the first ends and second ends with a continuous seam.

5. The undergarment of claim 2, wherein the lateral length of the first and second overlap regions is greater than 0.75 inches.

6. The undergarment of claim 2, wherein the lateral length of the first and second overlap regions is greater than 1 inch.

7. The undergarment of claim 2, wherein at least one of the overlap regions is diamond shaped.

8. The undergarment of claim 2, wherein a vertical length of at least one of the overlap regions increases and decreases along its lateral length.

9. The undergarment of claim 2, wherein the fabric comprises a first layer and a second layer, and wherein the undergarment does not include elastic.

10. The undergarment of claim 2, wherein the fabric comprises a first layer and a second layer, and wherein the undergarment does not include a draw string.

11. The undergarment of claim 2, wherein the fabric comprises a first layer and a second layer, and wherein the fabric consists of natural fibers.

12. The undergarment of claim 2, wherein the fabric comprises a first layer and a second layer, and wherein the fabric consists of a blend of natural fibers and synthetic fibers.

13. The undergarment of claim 2, wherein the fabric comprises a first layer and a second layer, and wherein each layer of fabric has a basis weight between 6 and 13 ounces per linear yard.

14. A method of making an undergarment, the method comprising:

folding a fabric along a central region positioned between upper and lower regions, the upper and lower regions corresponding to rear and front portions of the undergarment and each including laterally positioned first and second ends;

overlapping the first ends of the upper and lower regions;

overlapping the second ends of the upper and lower regions; and attaching the overlapped first ends and overlapped second ends to form respective first and second overlap regions, and wherein the first overlap region comprises a lateral length of about 0.5 inches or more, and the second overlap region comprises a lateral length of about 0.5 inches or more.

15. The method of claim 14, wherein the lateral length of the first and second overlap regions is greater than 0.75 inches.

16. The method of claim 14, wherein the lateral length of the first and second overlap regions is greater than 1 inch.

17. The method of claim 14, wherein a vertical length of at least one of the overlap regions increases and decreases along its lateral length.

18. The method of claim 14, wherein at least one of the overlap regions is diamond shaped.

19. The method of claim 14, wherein the fabric comprises a first layer and a second layer.

20. The method of claim 14, wherein the method further comprises attaching the first and second layers and the respective first ends and second ends of the upper and lower regions with a continuous seam.

* * * * *